United States Patent [19]

Iida et al.

[11] 4,262,454

[45] Apr. 21, 1981

[54] WORKPIECE ROTATIONAL SPEED CONTROLLER FOR CAM GRINDING MACHINE

[75] Inventors: Wataru Iida, Aichi; Toshio Tsujiuchi, Anjou; Shintaro Ishikawa, Okazaki, all of Japan

[73] Assignee: Toyoda-Koki Kabushiki-Kaisha, Kariya, Japan

[21] Appl. No.: 44,654

[22] Filed: Jun. 1, 1979

[30] Foreign Application Priority Data

Jun. 20, 1978 [JP] Japan ..... 53-74382

[51] Int. Cl.[3] ..... B24B 19/12

[52] U.S. Cl. ..... 51/97 NC; 51/101 R; 51/165.71; 318/571; 409/168

[58] Field of Search ..... 51/96, 97 R, 97 NC, 51/101 R, 165.71; 318/571, 602, 603; 364/474, 475; 409/199, 200, 153, 168, 195

[56] References Cited

U.S. PATENT DOCUMENTS

| | | | |
|---|---|---|---|
| 3,586,953 | 6/1971 | Markkanen | 318/603 X |
| 3,843,915 | 10/1974 | Helmbold | 318/603 X |
| 3,956,617 | 5/1976 | Schmidt | 364/475 |
| 4,094,105 | 6/1978 | Hatanaka et al. | 51/101 R |
| 4,102,082 | 7/1978 | Katsumi et al. | 51/101 R |
| 4,110,676 | 8/1978 | Enomoto | 318/571 |
| 4,122,634 | 10/1978 | Nishimura | 51/101 R |

FOREIGN PATENT DOCUMENTS

| | | | |
|---|---|---|---|
| 1387113 | 3/1975 | United Kingdom | 51/101 R |

*Primary Examiner*—Gary L. Smith
*Assistant Examiner*—Robert P. Olszewski
*Attorney, Agent, or Firm*—Oblon, Fisher, Spivak, McClelland & Maier

[57] ABSTRACT

A workpiece rotational speed controller having a pulse counter responsive to a pulse signal generated from a pulse generator for indicating the actual angular position of a cam shaft during grinding on a cam grinding machine and a comparator for comparing a count value of the counter with any one of set values which are set in a plurality of digital switches to designate respective speed change positions. A region detection counter is further provided, which counts any coincidence signal from the comparator so as to enable a command voltage generator to apply to a servomotor for cam shaft drive a command voltage that changes step by step in correspondence to the region detection counter output. This counter output is also applied to a gate circuit, which is thus enabled to selectively apply the set values of the digital switches to the comparator.

6 Claims, 7 Drawing Figures

PULSE COUNTER
UP
RESET
50
DECODER
51
COMPARATOR
52
REGION COUNTER
53
DECODER
54
56
57
RCB
RCB
FF2
FF1
AG1
AG2
AG3
AG4
AG5
AG6
AG7
OG1
OG2
OG3
DL
EQS
CDS
DB
PCB
RDS
ZDS
C1
C2
C3
C4
G1
G2
G3
G4
G5
G6
G7
G8
DS11
DS12
DS13
DS14
DS21
DS22
DS23
DS24
α1
α1+90
α1+180
α1+270
θ1
θ2
θ3
θ4
+Vcc
VR1
VR2
VR3
VR4
VR5
E1
E2
E3
E4
E5
AS1
AS2
AS3
AS4
AS5
OP
VCS1

WORKPIECE ROTATIONAL SPEED CONTROLLER FOR CAM GRINDING MACHINE

BACKGROUND OF THE INVENTION

1. Field of the Invention

The present invention relates to a controller for controlling the rotational speed of a cam shaft in such a manner as to maintain the grinding speed constant during grinding on a cam grinding machine. More particularly, it relates to a controller for maintaining the grinding speed constant by applying to a servomotor, for cam shaft drive, a velocity command voltage whose level is changed step by step in correspondence to the rotational angular positions of the cam shaft.

2. Brief Description of the Prior Art

Generally, the grinding of cams on a cam shaft rotating at a constant speed causes the grinding speed to change in correspondence to the rotational angle of the shaft. For example, in the case of grinding a cam CM shown in FIG. 1, the grinding speeds at a base circle portion B and a top portion T of the cam CM are in proportion respectively to the lengthes of their radii, whilst the grinding speed at each side portion S rapidly changes due to the fact that a small change of the rotational angle effects a large travel of a grinding point P where a grinding wheel G contacts the cam CM.

FIG. 2 shows a relationship between the cam rotational angle and the grinding speed in the case of a constant cam rotational speed. It will be understood therefrom that the grinding speed is rapidly increased in the vicinity of a 140-degree angular position and of a 220-degree angular position where the grinding point P is on either of the side portions S. The rapid increase of the grinding speed creates excessive grinding resistance upon the wheel surface, and this results not only in uneven or local abrasion of the grinding wheel surface, but also a profile error in the final accuracy of the cam.

For the purpose of solving these drawbacks, there have recently been suggested various methods for controlling the cam grinding speed to be constant by changing a velocity command voltage applied to a cam drive servomotor, in correspondence to the rotational angular position of the cam CM. These methods are roughly grouped in three classes. In a first method the rocking angular position of a rocking table for carrying a cam shaft is detected so as to apply to a cam drive servomotor a velocity command voltage proportional to the detected rocking angular position. A second method involves storing in a semiconductor memory a plurality of velocity command values corresponding respectively to cam shaft rotational angular positions, and these values are successively read out in correspondence to the angular positions so as to be converted into respective analog signals for application to a cam drive servomotor. A third method uses a counter for detecting the actual rotational angular positions of a cam shaft by counting pulses which are generated in synchronism with the cam shaft rotation, and the counter count values serve to discriminate cam shaft rotational speed change positions with the result of changing step by step the velocity command voltage applied to a cam drive servomotor.

However, in the first method, it is impossible to compensate for an increase of the grinding speed which is caused by the travel of the grinding point P on each side portion S, since the method is intended to change the rotational speed of the cam shaft in proportion to a change in cam lift at the grinding point P. Since the second method stores the velocity command values in a semiconductor memory it is therefore difficult not only to set, but also to alter the stored velocity command values, and furthermore the provision of a digital to analog converter is also necessary. For these reasons, the third method is considered best in terms of both accuracy and manipulation. However, in the third method, the cam rotational speed change positions are detected in accordance with the count value indicated by the counter. Therefore, to detect whether the count value has been increased to any of preselected values or not, there are required a number of comparators corresponding to the number of speed change positions, thus complicating an electric control circuit for this method.

SUMMARY OF THE INVENTION

Accordingly, it is a primary object of the present invention to provide a workpiece rotational speed controller for a cam grinding machine in which only one comparator is able to serve for detecting a plurality of rotational speed change positions, thus achieving cam rotational speed control by the use of a simplified circuit.

Another object of the invention is the provision of a workpiece rotational speed controller of the character set forth above wherein the provision of a compensating circuit enables a common speed control circuit to serve as the speed control for a plurality of cams which are provided on a cam shaft with different angular orientations.

Briefly, according to the present invention, there is provided a workpiece rotational speed controller for a cam grinding machine wherein the rotation of a cam shaft to be ground and the rocking motion of a rocking table for carrying the cam shaft are effected by a servomotor in synchronism with each other. The controller includes a pulse generator for generating a pulse signal each time of a unit angular rotation of the cam shaft, a pulse counter for detecting the rotational angular position of the cam shaft by counting the pulse signal, a plurality of setting elements each for designating angular positions where the rotational speed of the cam shaft is to be changed, and a comparator for comparing a count value of the pulse counter with any of set values set respectively in the setting elements. The comparator, upon coincidence therebetween, applies a coincidence signal to a region detection counter, which counts the coincidence signal for indicating any of rotational regions within which the cam shaft exists.

The controller further includes a command voltage generating circuit and a gate circuit. The generating circuit is connected to the region detection counter and the servomotor and applies to the servomotor a command voltage which is changed step by step in correspondence to a count value of the region detection counter. The gate circuit is responsive to the count value of the region detection counter so as to selectively apply the set values of the setting elements to the comparator, so that the same is able to successively detect the respective times at which the cam shaft reaches a plurality of speed change positions.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF A PREFERRED EMBODIMENT

Figure 3:
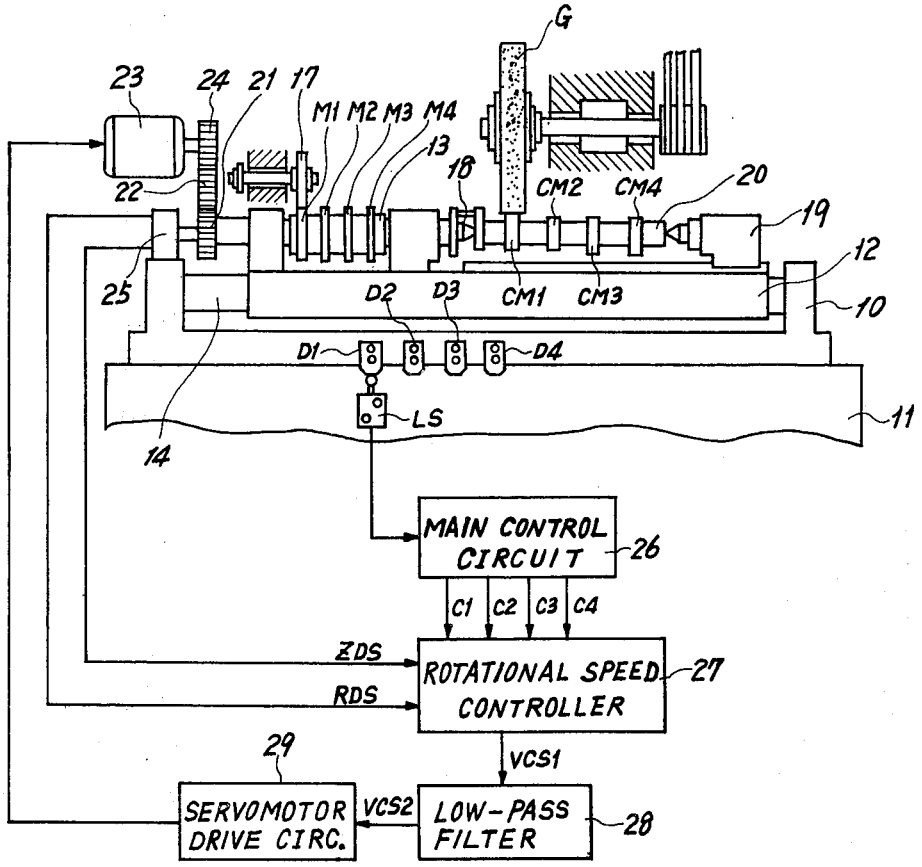
FIG. 3 is a schematic view of a cam grinding machine having a workpiece operational speed controller according to the invention.
Figure 4:
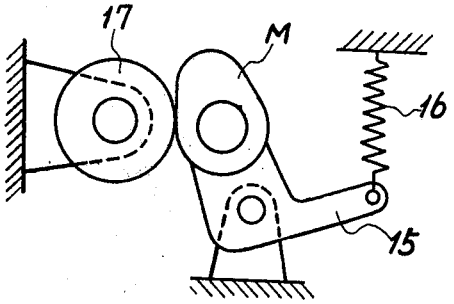
FIG. 4 is a schematic view illustrative of a rocking mechanism of the apparatus shown in FIG. 3.

Referring now to the drawings, wherein like reference numerals designate identical or corresponding parts throughout the several views, and more particularly to FIG. 3 thereof, a bed 11 of a cam grinding machine has mounted thereon a slide table 10, on which a rocking table 12 is in turn mounted for rocking motion about a pivot axis 14 parallel to the rotational axis of a grinding wheel G. A work spindle 13 is rotatably carried on a left portion of the rocking table 12 in parallel relation with the pivot axis 14, and a number of master cams M1–M4 each having a cam profile similar to that of the corresponding one of cams CM1–CM4 referred to later are keyed on the work spindle 13, with different angular phase dispositions. As shown in FIG. 4, a rocking mechanism comprises a spring 16, which urges through a swing arm 15 protruded from the rocking table 12 a selected one of the master cams M1–M4 to contact a follower roller 17, which is rotatably carried as is well-known in the art.

One end of the work spindle 13 is securely receiving a center 18, which cooperates with a center, not numbered, of a foot stock 19 for rotatably carrying therebetween a cam shaft 20 having a number of cams CM1–CM4 to be ground to the same profile, the cams CM1–CM4 being different in angular phase from each other. Keyed on a left end of the work spindle 13 is a gear 21, which is in meshing engagement through an idle gear 22 with a gear 24 keyed on an output shaft of a servomotor 23. The left end of the work spindle 13 is also connected to a pulse generator 25, which generates a unit rotation pulse RDS each time the work spindle 13, to which the cam shaft 20 is connectable in a usual manner for integral rotation, rotates through an angle of one degree. Pulse generator 25 also generates an original position signal ZDS each time the work spindle 13 reaches a predetermined angular position. A number of dogs D1–D4 and a limit switch LS are fixedly provided respectively on the slide table 10 and the bed 11 for positioning the slide table 10 at a number of longitudinal positions where the cams CM1–CM4 are located at a grinding position. The signal from the limit switch LS is applied to a main control circuit 26. This control circuit 26 is provided for controlling a full automatic grinding cycle of the cams CM1–CM4 of the cam shaft 20. The control circuit 26 is further operable to detect which one of cams CM1–CM4 has been indexed to the grinding position, by receiving the signal from the limit switch LS and to output any of selection signals C1–C4 when one of the cams CM–CM4 corresponding to the selection signal is indexed to the grinding position. The control circuit 26 is conventional and well-known in the art, and therefor, further description with respect thereto will be omitted for the sake of brevity.

Description is then made of an electric circuit for controlling the rotational speed of the cam shaft 20. This circuit includes a workpiece rotational speed controller 27 for generating a velocity command voltage VCS1 which changes as the rotational angular position of any cam advances, a low-pass filter 28 for smoothing the change of rotational speed of the cam shaft 20 by converting any rapid change of the velocity command voltage VCS1 output from the controller 27 into a gradual change, and a servomotor drive circuit 29 for rotationally driving the servomotor 23 at a speed corresponding to a velocity command voltage VCS2 output from the low-pass filter 28. The rotational speed controller 27 is further given a function to compensate for the angular phase difference between a particular or first cam CM1 and any of other cams CM2–CM4, so that as will be described in detail hereinafter, the speed control of all of the cams CM1–CM4 can be attained by the use of a common circuit.

Figure 5:
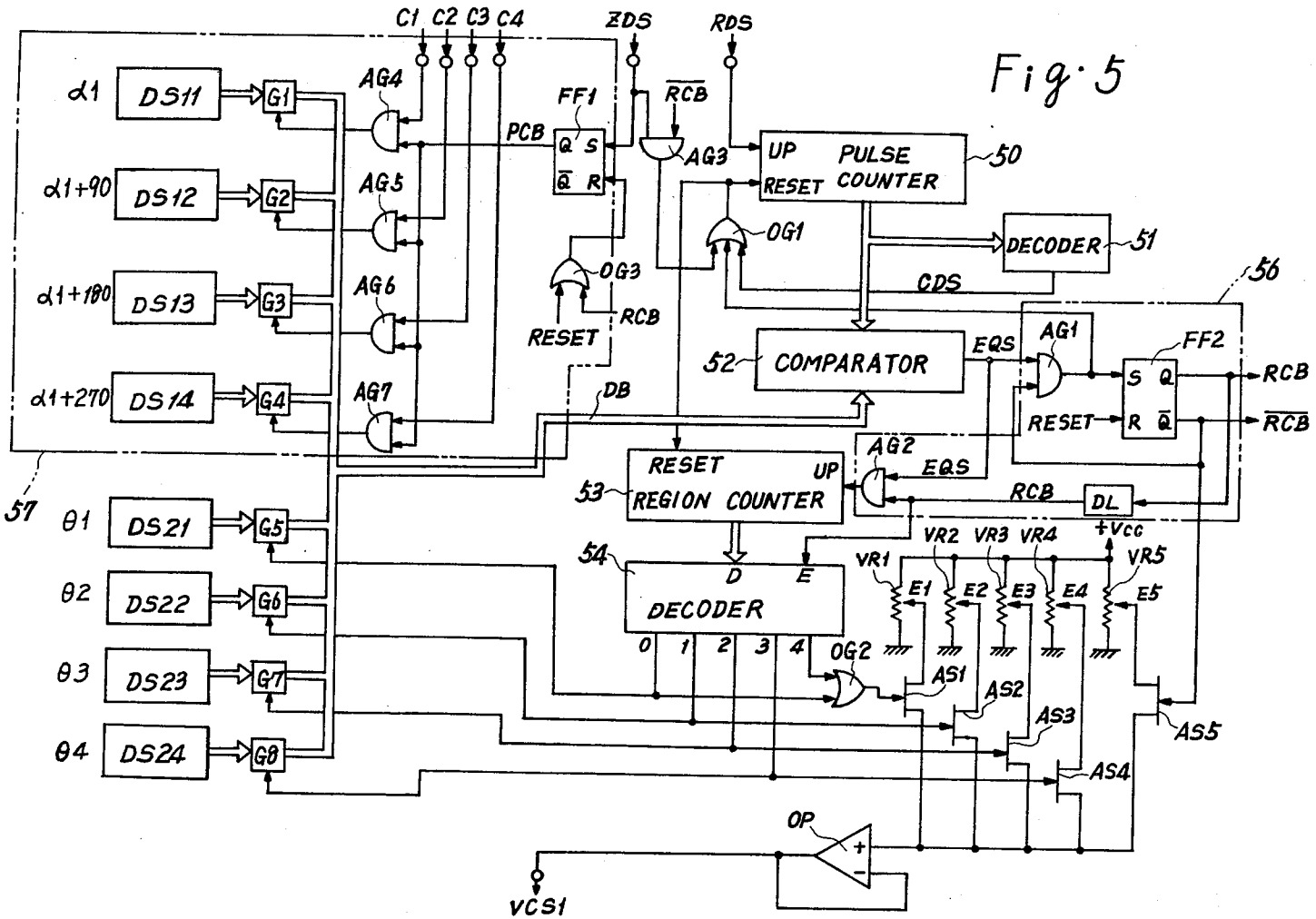
FIG. 5 is a block diagram of the rotational speed controller shown in FIG. 3.

FIG. 5 is a block diagram illustrative of the construction of the rotational speed controller 27. This controller 27 is connected to receive the unit rotation pulse RDS and the original position pulse ZDS from the pulse generator 25 and to also receive from the main control circuit 26 the selection signals C1–C4. A pulse counter 50 is provided for counting the unit rotation pulses RDS output from the pulse generator 25 and is connected to receive the unit rotation pulses RDS at its addition terminal UP and to output a count value thereof to a decoder 51 and a comparator 52. The pulse counter 50 is resettable by a signal supplied to its reset terminal RESET from an OR gate OG1. The function of the decoder 51 is to detect whether or not the count value of the pulse counter 50 has reached number 360. A detection signal CDS from the decoder 51 is an input to the OR gate OG1 for resetting the pulse counter 51 as well as a region detection counter referred to later.

The comparator 52 compares the count value of the pulse counter 50 with a set value, which is being preset in a selected one of digital switches DS11-DS24, and emits a coincidence signal EQS when the count value of the pulse counter 50 coincides with the set value of the selected digital switch. Connection is made to apply, through an AND gate AG1, the coincidence signal EQS to the OR gate OG1 as well as to a set input terminal S of a flip-flop FF2 constituting a control direction circuit 56. The coincidence signal EQS is also input to an AND gate AG2 so as to be applied therethrough to a step-up terminal UP of a region detection counter 53.

The AND gate AG1 is connected to receive a signal $\overline{RCB}$ from a reset output terminal $\overline{Q}$ of the flip-flop FF2, and the AND gate AG2 is connected to receive a signal RCB from a set output terminal Q of the flip-flop FF2 through a delay circuit DL. Thus, the coincidence signal EQS output from the comparator 52 is supplied as a reset signal to the pulse counter 50 when the flip-flop FF2 is in a reset state and as an addition signal to the step-up terminal UP of the region detection counter 53 when the flip-flop FF2 is in a set state.

The OR gate OG1 is connected at another input terminal thereof to an output terminal of the AND gate AG3, which permits the original position pulse ZDS from the pulse generator 25 to pass therethrough when receiving the signal $\overline{RCB}$ from the reset terminal $\overline{Q}$ of the flip-flop FF2. Thus, when the flip-flop FF2 is maintained reset, the pulse counter 50 is reset in response to the original position pulse ZDS output from the pulse generator 25. The output signal of the OR gate OG1 is further applied to a reset terminal RESET of the region detection counter 53, so that the same is reset concurrently with the resetting of the pulse counter 50.

Figure 6:
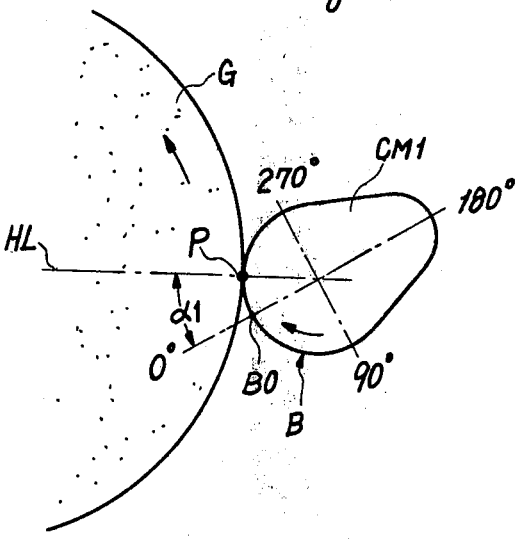
FIG. 6 is a schematic illustration showing a compensating angle to be set for a first cam CM1.

The digital switches DS11–DS14 constituting a compenstating circuit 57 are preset respectively with rotational angles at positions of which the cams CM1–CM4 are respectively located when the original position pulse ZDS is output from the pulse generator 25. For example, assuming now that the relative angular phase between the cam shaft 20 and the work spindle 13 is so determined that the first cam CM1 is at an angular position as shown in FIG. 6 when the original position pulse ZDS is generated from the pulse generator 25 an angle $\alpha 1$ that a horizon HL makes against the median B0 of a base circle portion B is preset as a compensation angle in the digital switch DS11. Assuming further that other cams CM2–CM4 have angular phases which advance respectively by 90-degrees, 180-degrees and 270-degrees from that of the first cam CM1, angles $\alpha 1+90$, $\alpha 1+180$ and $\alpha 1+270$ are preset as compensation angles in the digital switches DS12-DS14, respectively. These preset values of the digital switches DS11-DS14 are selectively applied to the comparator 52 via related gates G1–G4, which are opened upon receipt of signals output from AND gates AG4–AG7, respectively. One input terminal of each of the AND gates AG4–AG7 is connected to receive a signal from the set output terminal Q of the flip-flop FF1, and other input terminals of the AND gates AG4–AG7 are connected to respectively receive the selection signals C1–C4, indicative of cam identification numbers, from the main control circuit 26. Therefore, when the flip-flop FF1 is set, the compensation angle for one of the cams CM1–CM4 which has been indexed to the grinding position is applied to the comparator 52 via a bus line DB.

Figure 1:
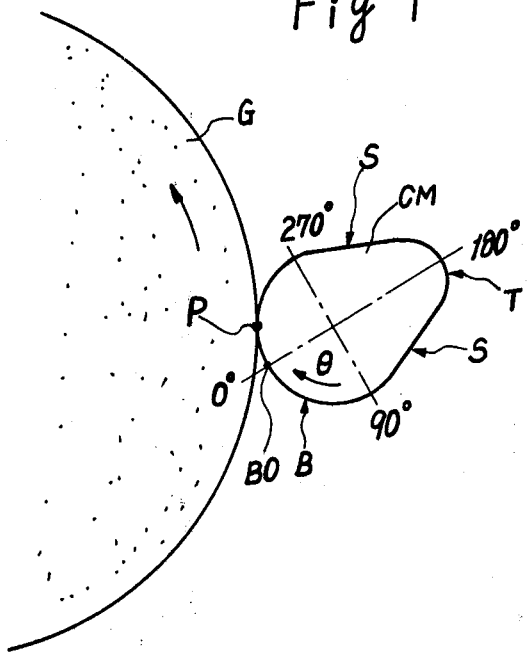
FIG. 1 is a schematic illustration of a grinding operation characterized by a variation in cam grinding speed.
Figure 2:
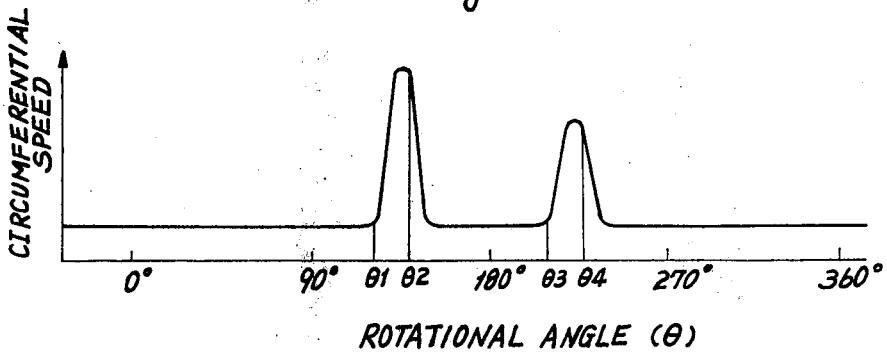
FIG. 2 is a graph illustrating circumferential grinding speed versus cam rotational angle in the grinding operation illustrated in FIG. 1.

The digital switches DS21–DS24 are provided for respectively presetting therein speed change angular positions and are commonly used for any of the cams CM1–CM4. The speed change angular positions preset in the digital switches DS21–DS24 are designated in the form of those angles that, in the first or reference cam CM1, the speed change angular positions make against the median B0 of the base circle portion B, respectively. In this particular embodiment, angles $\theta 1$–$\theta 4$ indicated in FIG. 2 are preset respectively in the digital switches DS21–DS24. These set values of the digital switches DS21–DS24 are selectively supplied to the comparator 52 through related gates G5–G8, which are connected to receive gate control signals respectively from output terminals 0–3 of a decoder 54. This decoder 54 is operable to decode the count value being stored in the region detection counter 53. Thus, when a signal is applied to an enable terminal E of the decoder 54, the gates G5–G8 are selectively opened in correspondence to the count value that the region detection counter 53 indicates.

The output terminals 0 and 4 of the decoder 54 are connected to a control terminal of an analog switch AS1 through an OR gate OG2, and other terminals 1–3 of the decoder 54 are connected respectively to control terminals of analog switches AS2–AS4. Further, a control terminal of an analog switch AS5 is connected to the reset output terminal $\overline{Q}$ of the flip-flop FF2. These analog switches AS1–AS5, when ignited, respectively apply set voltages E1-E5 being set by variable resistances VR1–VR5, to an operation amplifier OP acting as a buffer amplifier, and an output from the operation amplifier OP is applied as the velocity command voltage VCS1 to the low-pass filter 28. The decoder 54 is further connected at its enable terminal E to the set terminal Q of the flip flop FF2 through the delay circuit DL so as to receive an enable signal RCB therefrom and, when enabled, outputs a gate control signal from any one of the output terminals 0–4. Accordingly, when the flip-flop FF2 is in the reset state, the set voltage E5 being set in the variable resistance VR5 is output as the velocity command voltage VCS1. On the contrary, when the flip-flop FF2 is set, any one of the set voltages E1–E4 being set respectively in the variable resistances VR1–VR4 is selected in accordance with the count values of the region detection counter 53 and is output as the velocity command voltage VCS1. It is noted herein that the set voltages E1–E4 are chosen for rotating any of the cams CM1–CM4 through angular regions $\theta 4$–$\theta 1$, $\theta 1$–$\theta 2$, $\theta 2$–$\theta 3$ and $\theta 3$–$\theta 4$ respectively at optimum rotational speeds and that the set voltage E5 is chosen for rotating the cam shaft 20 at a faster rotational speed than any of the optimum rotational speeds.

The functions of the flip-flops FF1 and FF2 are to store the operational status of the rotational speed controller 27. The flip-flop FF1 is set in response to the original position pulse ZDS output from the pulse generator 25 and is reset in response to the signal RCB output from the set output terminal Q of the flip-flop FF2. The flip-flop FF2 is set upon receiving the coincidence signal EQS from the AND gate AG1. Further, these flip-flops FF1 and FF2 are connected to receive an initial resetting signal RESET at their reset input terminals R, so that they are reset each time the cam shaft 20 begins to rotate for grinding any one of the cams CM1–CM4.

Figure 7:
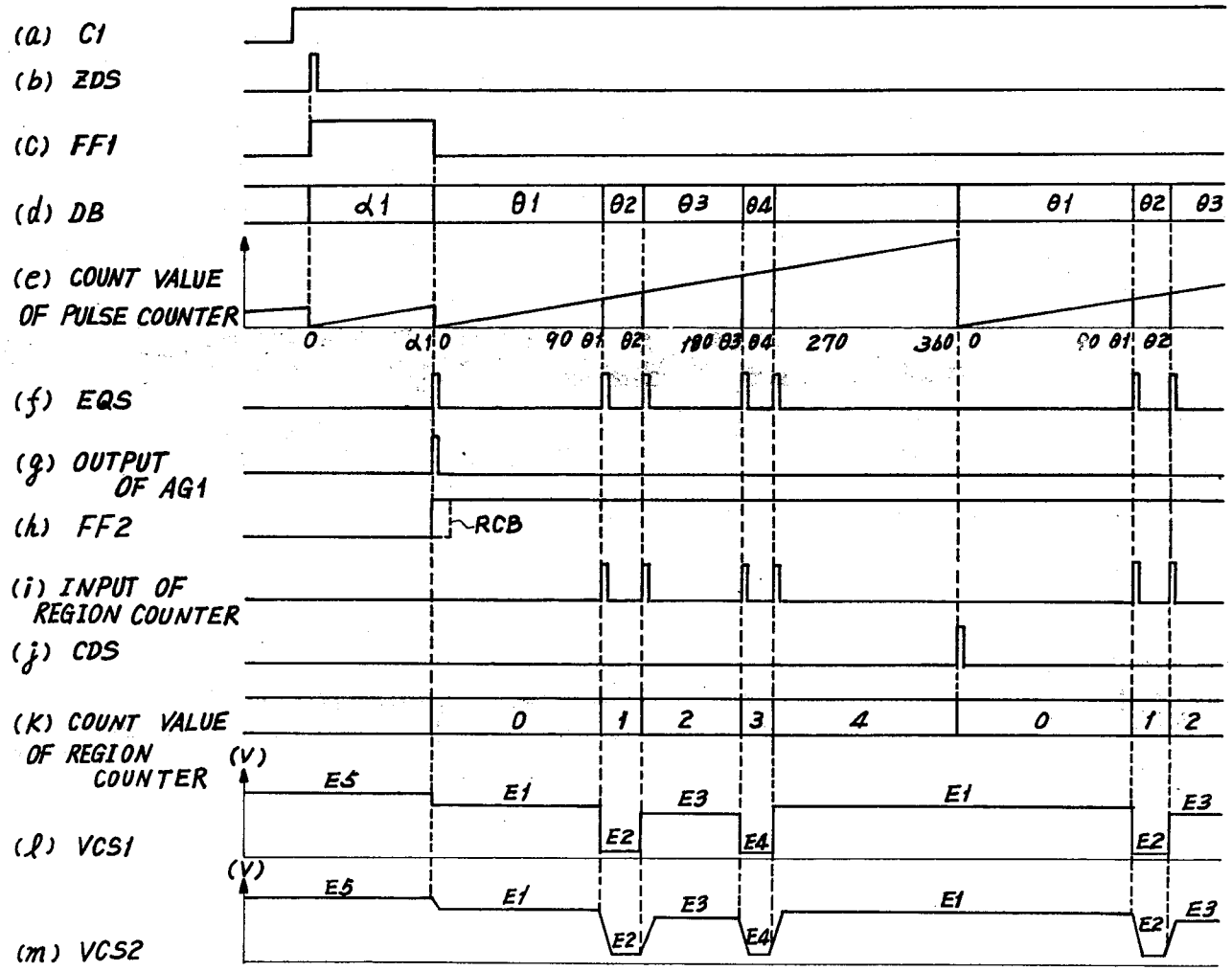
FIG. 7 is a timing chart for explaining the operations of selected circuit components constituting the rotational speed controller.

The operation in grinding the first cam CM1, of the apparatus as constructed above will be described hereunder with reference to a time chart shown in FIG. 7. At the initiation of the operation, the reset signal RESET is applied to both of the flip-flops FF1 and FF2, which are thus reset. The resetting of the flip-flop FF2 causes the analog switch AS5 to conduct, by which the set voltage E5 is applied to the servomotor drive circuit 29, whereby the cam shaft 20 is rotated at a fast rotational speed.

Each time the cam shaft 20 is rotated through an angle of one degree, the pulse generator 25 generates the unit rotation pulse RDS to increment the content of the pulse counter 50 by one. When the cam shaft 20, together with the work spindle 13, is thereafter rotated to the angular position causing the pulse generator 25 to generate the original position pulse ZDS, the flip-flop FF1 is set in response to the original position pulse ZDS. This pulse is simultaneously applied to the reset input terminal RESET of the pulse counter 50, which is thus reset to have its content reduced to zero.

The flip-flop FF1, when so set, outputs the selection enable signal PCB from its set output terminal Q to one input terminal of each of the AND gates AG4–AG7. Since at this time, the main control circuit 26 has emitted the selection signal C1 indicating that the first cam CM1 has been indexed to the grinding position; namely that the first cam CM1 is in alignment with the grinding wheel G, the AND gate AG4 outputs a signal to open the gate G1. Consequently, data being set in the digital switch DS11 and indicative of the compensation angle $\alpha 1$ is supplied to the comparator 52 via the bus line DB. Further rotation of the cam shaft 20 causes the pulse generator 25 to generate the unit rotation pulses RDS which correspond in number to the angle of such rotation. It will therefore be understood that the count value stored in the pulse counter 50 after the same is reset by means of the original position pulse ZDS indicates a rotational angle or amount through which the cam shaft 20 has been rotated after the generation by the pulse generator 25 of the original position pulse ZDS.

When the cam shaft 20 is rotated through the compensation angle $\alpha 1$ after the generation by the pulse generator 25 of the original position pulse ZDS, the median B0 on the base circle portion B of the first cam CM1 is moved to the grinding point P, and the content of the pulse counter 50 becomes $\alpha 1$. This is detected by the comparator 52, which thus emits the coincidence signal EQS. The flip-flop FF2 has still been maintained reset, causing the AND gate AG1 to be ready for opening, and therefore, the emission of the coincidence signal EQS from the comparator 52 effects resetting the pulse counter 50 and the region detection counter 53 as well as setting the flip-flop FF2. The content of the pulse counter 50 is thus cleared to indicate zero. It will therefore be realized that from this time, the pulse counter 50 operates to indicate a rotational amount that the first cam CM1 will have rotated through from a start position where the median B0 of the base circle portion B of the first cam CM1 is on the grinding point P.

The setting of the flip-flop FF2 causes the resetting of the flip-flop FF1 so as to close the gate G1 and the AND gate AG4. It further causes, with a certain time delay, the AND gate AG2 to be ready for applying to the step-up terminal UP of the region detection counter 53 the coincidence signal EQS that will subsequently be emitted from the comparator 52.

The signal RCB from the delay circuit DL is also applied, as well as to the AND gate AG2, to the enable terminal E of the decoder 54, which is thus enabled to emit a signal from one of its output terminals 0–4 which corresponds to the count value of the region detection counter 53. Since the count value of the counter 53 is zero at this time, a signal is output from the output terminal 0 of the decoder 54 so as to switch conductive the analog switch AS1. Consequently, the set voltage E1 is supplied as the velocity command voltage to the servomotor drive circuit 29, whereby the rotational speed of the cam shaft 20 is changed to that which is optimum for grinding of the base circle portion B. The emission of the signal from the output terminal 0 of the decoder 54 further causes the opening of the gate G5, through which data indicative of the velocity change position $\theta 1$ is then applied from the digital switch DS21 to the comparator 52.

When the first cam CM1 is subsequently rotated by an angular extent $\theta 1$, the pulse counter 50 has a count value coinciding with the set value $\theta 1$ of the digital switch DS21, and this causes the comparator 52 to emit the coincidence signal EQS again. The region detection counter 53 increments its content so as to have one (1). The analog switch AS2 is thus switched conductive with the result of applying to the servomotor drive circuit 29 the set voltage E2 which is considerably lower in level than the set voltage E1. The rotational speed of the cam shaft 20 is therefore decreased so as to grind one side portion S of the first cam CM1 at an optimum speed therefor. With the content of the region detection counter 53 increased to one (1), data indicative of another velocity change position $\theta 2$ is supplied from the digital switch DS22 to the comparator 52 so as to be compared with the count value of the pulse counter 50.

When the first cam CM1 is rotated to the change position $\theta 2$, the coincidence signal EQS is output from the comparator 52 so as to cause the region detection counter 53 to count up to two (2). As a result, the set voltage E3 optimum for grinding of the top portion T of the first cam CM1 is supplied to the servomotor drive circuit 29, and data indicative of another velocity change position $\theta 3$ is supplied from the digital switch DS23 to the comparator 52.

Operation is thereafter advanced in a manner similar to the above, and with the first cam CM1 rotating to angular position $\theta 3$, the content of the region detection counter 53 is increased to three (3) so as to change the velocity command voltage VCS1 to the set voltage E4. Thus, the other side portion S of the first cam CM1 is ground at a rotational speed corresponding to the now selected set voltage E4, and a velocity change position data supplied to the comparator 52 is changed from $\theta 3$ to $\theta 4$. Further, the rotation of the first cam CM1 to the angular position $\theta 4$ effects increasing the content of the region detection counter 53 to four (4), whereby the base circle portion B of the first cam CM1 is ground at a rotational speed corresponding to the set voltage E1. When the median B0 of the base circle portion B of the first cam CM1 arrives at the grinding point P after one rotation, the count value of the pulse counter 50 is increased to 360. This enables the decoder 51 to emit the detection signal CDS so as to reset the pulse counter 50 and the region detection counter 53. Thus, the count value of the pulse counter 50 is adjusted to precisely indicate an angular distance between the median B0 of the base circle portion B of the first cam CM1 and the grinding point P, and the set value $\theta 1$ being set in the digital switch DS21 is supplied to the comparator 52.

The changing of the velocity command voltage VS1 and the switching of the velocity change positions designated to the comparator 52 are effected in the foregoing manner each time the first cam CM1 is rotated to any one of the change positions $\theta 1$–$\theta 4$. Therefore, all of the base circle portion B, the side portion S and the top portion T of the first cam CM1 are ground at respective optimum rotational speeds, so that the first cam CM1 is ground to have a precise profile. Since the grinding speed is maintained approximately constant throughout all the angular regions, the grinding wheel G can be prevented from suffering large impactive grinding resistance, thus resulting in the elongation of the wheel life. In the above-described embodiment, the set values $\theta 1$–$\theta 4$ for velocity change angular positions and the set voltages E1–E4 for velocity command voltage are commonly used for all of the cams CM1–CM4 because of these cams CM1–CM4 having the same profile. However, in the case where one or more cams of the cams CM1–CM4 are different from others in profile, either or both of a digital switch for setting a velocity change position and a pair of variable resistance such as VR1 and an analog switch such as AS1 may be added for each of the cams having the different profiles, and the digital switch and/or the pair of the resistance and the analog switch may be selected for the grinding of the corresponding cam having the different profile. Even in this case, the circuit for detecting the velocity change positions is not unduly complicated since no additional comparator is required for comparing the count value of the pulse counter with the set value of any digital switches.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by the letters patent of the United States is:

1. A workpiece rotational speed controller in a cam grinding machine having workpiece support means for rotatably supporting a cam shaft to be ground, a rocking mechanism for pivotally moving said workpiece support means about a pivot axis parallel to the axis of said cam shaft, and a servomotor for rotating said cam shaft and driving said rocking mechanism in synchronism with the rotation of said cam shaft, said controller comprising:

a pulse generator for generating a pulse signal each time of a unit angle rotation of said cam shaft;

a pulse counter for detecting the rotational angular position of said cam shaft by counting said pulse signal supplied from said pulse generator;

a plurality of digital setting elements each for digitally setting an angular position where the rotational speed of said cam shaft is to be changed;

a comparator for comparing a count value of said pulse counter with any of set values set respectively in said plurality of said setting elements and for emitting a coincidence signal upon the coincidence therebetween;

a region detection counter connected to said comparator for counting a coincidence signal supplied from said comparator;

gate circuit means responsive to said count value of said region detection counter for selectively applying said set values of said plurality of said setting elements to said comparator;

a plurality of adjustable command voltage generating elements for generating various command voltages;

command voltage selecting means connected to said region detection counter for selecting one of said command voltages from said command voltage generating elements in correspondence to a count value of said region detection counter; and command voltage smoothing means connected between said command voltage selecting means and said servomotor for converting a rapid change of a selected command voltage output from said command voltage selecting means into a gradual change and applying a smoothed command voltage to said servomotor.

2. A workpiece rotational speed controller as set forth in claim 1, further comprising:

means connected to said pulse counter and said region detection counter for resetting these counters each time said count value of said pulse counter indicates the completion of one rotation of said cam shaft.

3. A workpiece rotational speed controller as set forth in either claim 1 or claim 2, wherein said cam shaft has a plurality of cams to be ground whose angular orientations are different from one another, and wherein said pulse generator is adapted to generate an original angular position signal each time the rotation of said cam shaft reaches a predetermined angular position, further comprising:

a control direction circuit for continuing the emissions of first and second direction signals respectively until and after said cam shaft is first rotated to said predetermined angular position in grinding any of said cams which is in alignment with said grinding wheel;

a first gate responsive to said first direction signal for passing said original angular position signal from said pulse generator to said pulse counter and said region detection counter so as to reset these counters;

a second gate responsive to said second direction signal for passing said coincidence signal from said comparator to said region detection counter; and compensating means responsive to said original angular position signal for applying to said comparator any of compensation values corresponding to one of said cams which is in alignment with said grinding wheel, said compensation values being indicative respectively of rotational angles through which said cams are rotated from said predetermined angular position to respective speed control start angular positions.

4. A workpiece rotational speed controller as set forth in claim 3, wherein said compensating means is adapted to selectively receive a plurality of selection signals each indicating that the corresponding one of said cams is in alignment with said grinding wheel and comprises:

a first flip-flop for emitting a selection enable signal when set in response to said original angular position signal and for stopping the emission of said selection enable signal when reset in response to said second direction signal supplied form said control direction circuit;

a plurality of digital switches for respectively setting said compensation values; and gate circuit means for applying any of said compensation values which is designated by one of said selection signals, to said comparator while receiving said selection enable signal from said first flip-flop.

5. A workpiece rotational speed controller as set forth in claim 4, wherein said control direction circuit comprises:

a second flip-flop for emitting said first direction signal when reset in response to a reset signal applied prior to each rotation of said cam shaft and for emitting said second direction signal when set;

a first AND gate responsive to said first direction signal for passing said coincidence signal from said comparator to said second flip-flop so as to set the same and also to said pulse counter and said region detection counter so as to reset these counters; and a second AND gate responsive to said second direction signal for passing said coincidence signal to said region detection counter.

6. A controller according to claim 1, wherein:

said adjustable command voltage generating elements comprise plural potentiometers connected in parallel across a reference voltage, each potentiometer having a wiper set to generate a command voltage corresponding to a respective count of said region detection counter; and said command voltage selecting means comprises, a region decoder coupled to said region detector counter and having plural outputs, said decoder activating said outputs sequentially in correspondence to respective counts of said region counter, an operational amplifier, and plural switches each having a signal input connected to a respective potentiometer wiper, a control input, and a signal output, the signal output of said switches connected in common to an input of said operational amplifier, the control inputs of said switches connected to a respective decoder output; and wherein respective potentiometer wiper voltages are sequentially applied to said operational amplifier input via respective of said switches under the control of said decoder in correspondence with the angular position of the cam.

* * * * *